US005593296A

United States Patent [19]

Bernstrom et al.

[11] Patent Number: 5,593,296

[45] Date of Patent: Jan. 14, 1997

[54] HYDRAULIC MOTOR AND PRESSURE RELIEVING MEANS FOR VALVE PLATE THEREOF

[75] Inventors: Marvin L. Bernstrom, Eden Prairie; Karen J. Radford, Minneapolis; Gary R. Kassen, Chanhassen, all of Minn.

[73] Assignee: Eaton Corporation, Cleveland, Ohio

[21] Appl. No.: 602,389

[22] Filed: Feb. 16, 1996

[51] Int. Cl.[6] ..... F01C 1/10; F03C 2/08

[52] U.S. Cl. ..... 418/61.3; 418/187

[58] Field of Search ..... 418/61.3, 186, 418/187

[56] References Cited

U.S. PATENT DOCUMENTS

| | | | |
|---|---|---|---|
| 3,270,683 | 9/1966 | McDermott | 418/61.3 |
| 3,289,542 | 12/1966 | Fikse | 418/61.3 |
| 4,390,329 | 6/1983 | Thorson | 418/61.3 |
| 4,411,607 | 10/1983 | Wüsthof et al. | 418/61.3 |
| 4,439,119 | 3/1984 | Petersen et al. | 418/61.3 |
| 4,597,725 | 7/1986 | Petersen et al. | 418/61.3 |
| 4,976,594 | 12/1990 | Bernstrom | 418/61.3 |
| 5,211,551 | 5/1993 | Uppal et al. | 418/61.3 |
| 5,516,268 | 5/1996 | Kassen et al. | 418/61.3 |

*Primary Examiner*—John J. Vrablik
*Attorney, Agent, or Firm*—L. J. Kasper

[57] ABSTRACT

A gerotor motor of the valve-in-star type in which the star (27) is disposed adjacent a stationary valve plate (15). The stationary valve plate (15) defines a plurality N+1 of valve passages (69), extending through the valve plate. On the surface (73) of the valve plate (15) adjacent the endcap member (14), the valve plate defines a plurality of pressure relieving recesses (79), each one being disposed between a pair of adjacent valve passages (69). Each of the recesses (79) is in fluid communication with an O-ring groove (81), which is at low pressure. Thus, any leakage from a high pressure passage (69) to an adjacent low pressure passage (69) is received within the intervening relieving recess (79), substantially eliminating any separating forces between the endcap member (14) and the stationary valve plate (15) This results in substantially improved volumetric efficiency of the motor at higher pressure differentials.

8 Claims, 4 Drawing Sheets

HYDRAULIC MOTOR AND PRESSURE RELIEVING MEANS FOR VALVE PLATE THEREOF

BACKGROUND OF THE DISCLOSURE

The present invention relates to rotary fluid pressure devices, and more particularly, to such devices which include gerotor displacement mechanisms utilizing low-speed, commutating valving.

In a conventional gerotor motors utilizing low-speed, commutating valve (i.e., the rotary valve element rotates at the speed of rotation of the gerotor star rather than at the orbiting speed of the star), the valving action has typically been accomplished by means of a rotary valve member and a stationary valve member, with both valve members being separate from the gerotor displacement mechanism.

In recent years, those skilled in the art have developed what may be termed a "valve-in-star" (VIS) gerotor motor, an example of which is illustrated and described in U.S. Pat. No. 4,741,681, assigned to the assignee of the present invention and incorporated herein by reference. In a VIS motor, the commutating valving action is accomplished at an interface between the orbiting and rotating gerotor star, and an adjacent, stationary valve plate, which is typically part of the motor housing, and more specifically, part of the endcap assembly.

Although "commutating" valving action is well known to those skilled in the gerotor motor art, a brief explanation will be provided herein. In a typical gerotor motor, the ring member defines a plurality N+1 of internal teeth, and the orbiting and rotating star defines a plurality N of external teeth. The stationary valve member then defines a plurality N+1 of valve passages communicating with the expanding and contracting fluid volume chambers of the gerotor, while the rotary valve member (orbiting and rotating star in the case of a VIS motor) defines a plurality N of fluid ports at high pressure ("system pressure"), and a plurality N of fluid ports at low pressure (return or exhaust). The progressive fluid communication between each of the N ports and each of the N+1 fluid passages in the stationary valve member, as the star orbits and rotates, comprises the commutating valving.

In the subject embodiment of the present invention, the stationary valve plate and the endcap member comprise two separate members, with the endcap member and the stationary valve member cooperating to define the inlet and outlet pressure regions, while the stationary valve member alone defines the N+1 valve passages communicating with the volume chambers of the gerotor. During the development of the commercial embodiment of the invention, it has been observed that the volumetric efficiency of the motor decreases as the pressure differential across the motor increases, which is to be expected, but that the decrease in volumetric efficiency is more drastic than what would normally be expected, and certainly more drastic than what is acceptable. It has been hypothesized that the drop in volumetric efficiency reflects a progressive increase in cross-port leakage, and in particular, cross-port leakage along the interface between the endcap member and the stationary valve member.

SUMMARY OF THE INVENTION

Accordingly, it is an object of the present invention to provide an improved VIS motor design which substantially reduces the possibility of cross-port leakage, i.e., leakage between the high pressure side of the motor and the low pressure side, thus improving the volumetric efficiency of the motor.

It is a more specific object of the present invention to provide an improved stationary valving arrangement for a VIS motor in which the stationary valve member remains in tight sealing engagement with the adjacent endcap member.

The above and other objects of the invention are accomplished by the provision of an improved rotary fluid pressure device of the type comprising housing means including an endcap assembly defining a fluid inlet port and a fluid outlet port. A gerotor gear set is associated with the housing means and includes an internally-toothed ring member defining a plurality N+1 of internal teeth, and an externally-toothed star member defining a plurality N of external teeth, the star member being eccentrically disposed within the ring member for relative orbital and rotational movement therebetween. The teeth of the ring member and the star member interengage to define a plurality N+1 of expanding and contracting fluid volume chambers during the relative orbital and rotational movements. The endcap assembly includes an endcap member and a stationary valve member, and the stationary valve member further defines a plurality N+1 of valve passages, each being oriented generally radially and being in continuous fluid communication with one of the fluid volume chambers. The star member defines first and second manifold zones in continuous fluid communication with the fluid inlet port and the fluid outlet port, respectively, the star member including an end surface disposed in sliding, sealing engagement with an adjacent surface of the stationary valve member. The end surface of the star member defines a first plurality N of fluid ports and a second plurality N of fluid ports, the first and second pluralities of fluid ports being in continuous fluid communication with the first and second manifold zones, respectively.

The improved rotary fluid pressure device is characterized by each of the valve passages being in fluid communication with the interface of the endcap member and the stationary valve member. One of the endcap member and the stationary valve member define a plurality of pressure relieving recesses, each of the pressure relieving recesses being elongated and oriented generally radially, and each of the recesses being disposed circumferentially between adjacent pairs of the valve passages. One of the endcap member and the stationary valve member define a region of relatively low fluid pressure disposed radially outward from the valve passages. Each of the pressure relieving recesses is in fluid communication with the region of relatively low fluid pressure, thereby relieving any fluid pressure buildup between the endcap member and the stationary valve member, tending to exert a separating force therebetween.

DESCRIPTION OF THE PREFERRED EMBODIMENT

Figure 1:
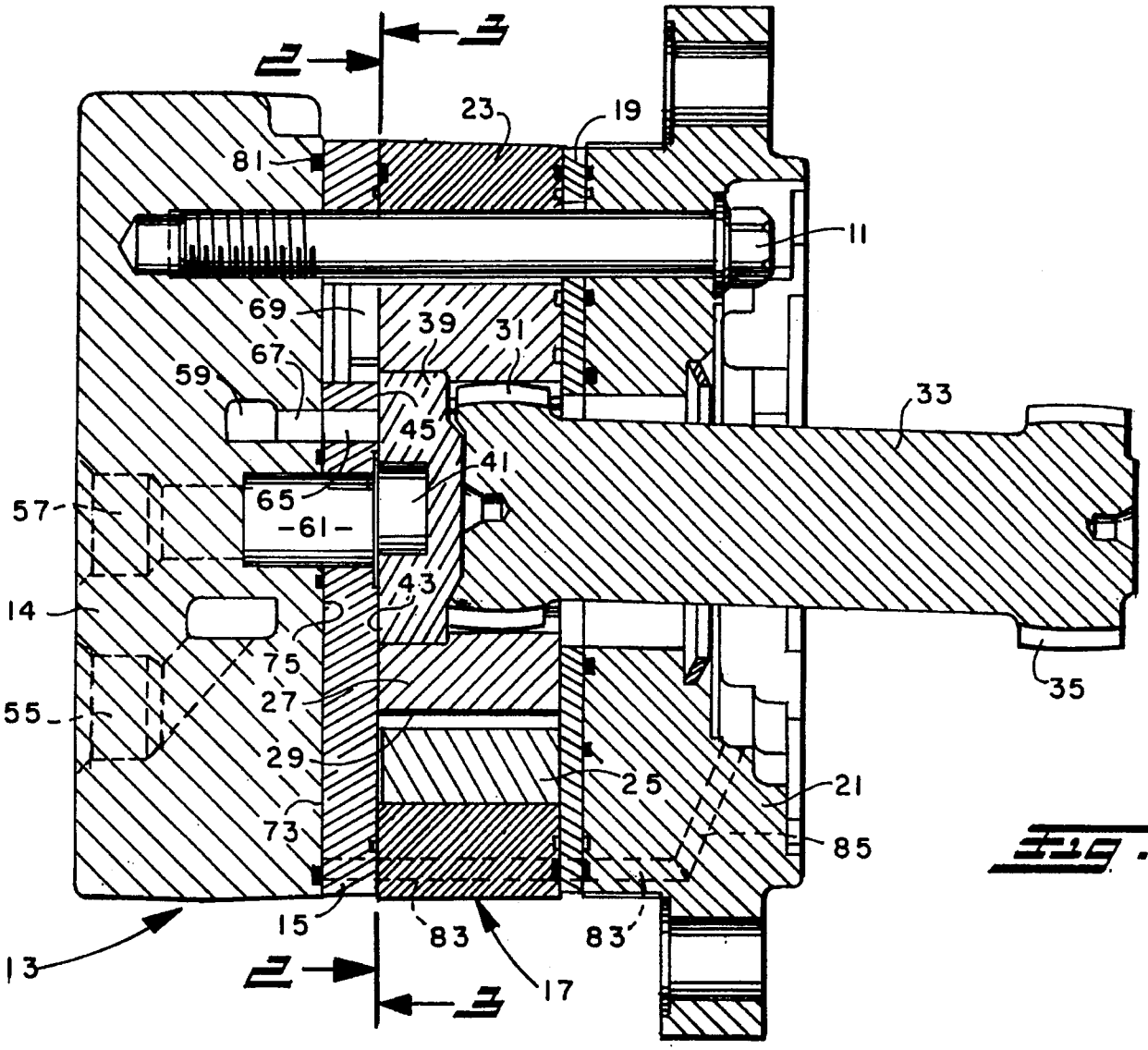
FIG. 1 is an axial cross-section illustrating a low-speed, high-torque VIS gerotor motor made in accordance with the present invention.

Referring now to the drawings, which are not intended to limit the invention, FIG. 1 illustrates a VIS motor made in accordance with the above-incorporated U.S. Pat. No. 4,741,681. More specifically, the VIS motor shown in FIG. 1 is, by way of example only, of a "modular" design, made in accordance with the teachings of U.S. Pat. No. 5,211,551, also assigned to the assignee of the present invention and incorporated herein by reference.

Figure 3:
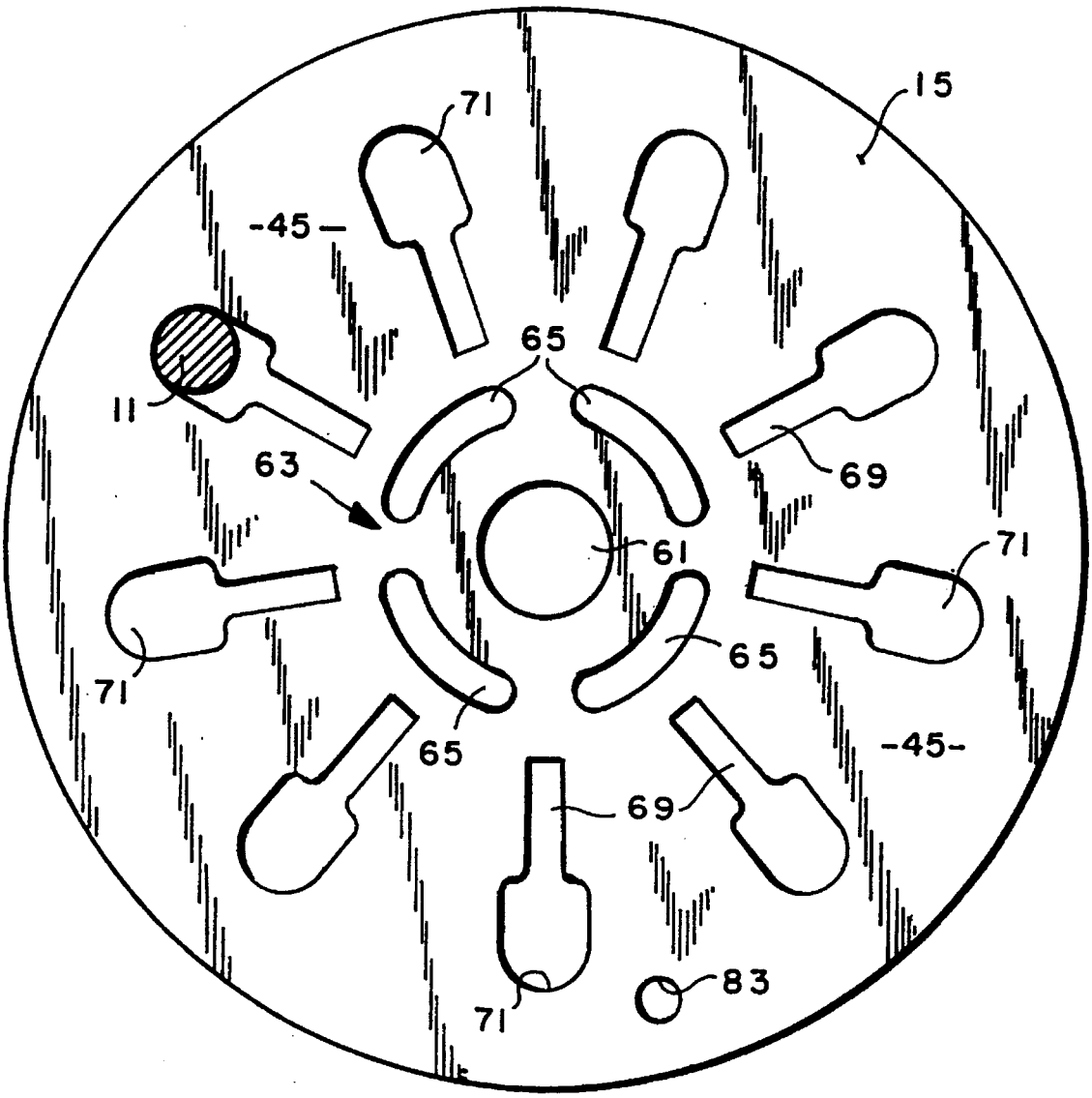
FIG. 3 is a transverse cross-section, taken on line 3—3 of FIG. 1, and on a scale larger than that of FIG. 1 but smaller than that of FIG. 2.

The VIS motor shown in FIG. 1 comprises a plurality of sections secured together such as by a plurality of bolts 11, only one of which is shown in each of FIGS. 1 and 3. The motor includes an endcap assembly generally designated 13. The assembly 13 includes an endcap member 14 and a stationary valve plate 15. The motor further includes a gerotor gear set, generally designated 17, a balance plate 19, and a flange member 21.

The gerotor gear set 17 is well known in the art, is shown and described in greater detail in the above-incorporated patents, and therefore will be described only briefly herein. The gear set 17 is preferably a Geroler® gear set comprising an internally toothed ring member 23 defining a plurality of generally semi-cylindrical openings, with a cylindrical roller member 25 disposed in each of the openings, and serving as the internal teeth of the ring member 23. Eccentrically disposed within the ring member 23 is an externally-toothed star member 27, typically having one less external tooth than the number of internal teeth 25, thus permitting the star member 27 to orbit and rotate relative to the ring member 23. The orbital and rotational movement of the star 27 within the ring 23 defines a plurality of expanding and contracting fluid volume chambers 29.

Referring still primarily to FIG. 1, the star 27 defines a plurality of straight, internal splines which are in engagement with a set of external, crowned splines 31, formed on one end of a main drive shaft 33. Disposed at the opposite end of the shaft 33 is another set of external, crowned splines 35, adapted to be in engagement with another set of straight internal splines defined by some form of rotary output member, such as a shaft or wheel hub (not shown). As is well known to those skilled in the art, gerotor motors of the general type shown herein may include an additional rotary output shaft, supported by suitable bearings. For purposes of the subsequent description, and the appended claims, the main drive shaft 33 may be considered a form of output shaft, and the splines 31 and 35 may be considered the means which transmits torque to the output shaft.

Figure 2:
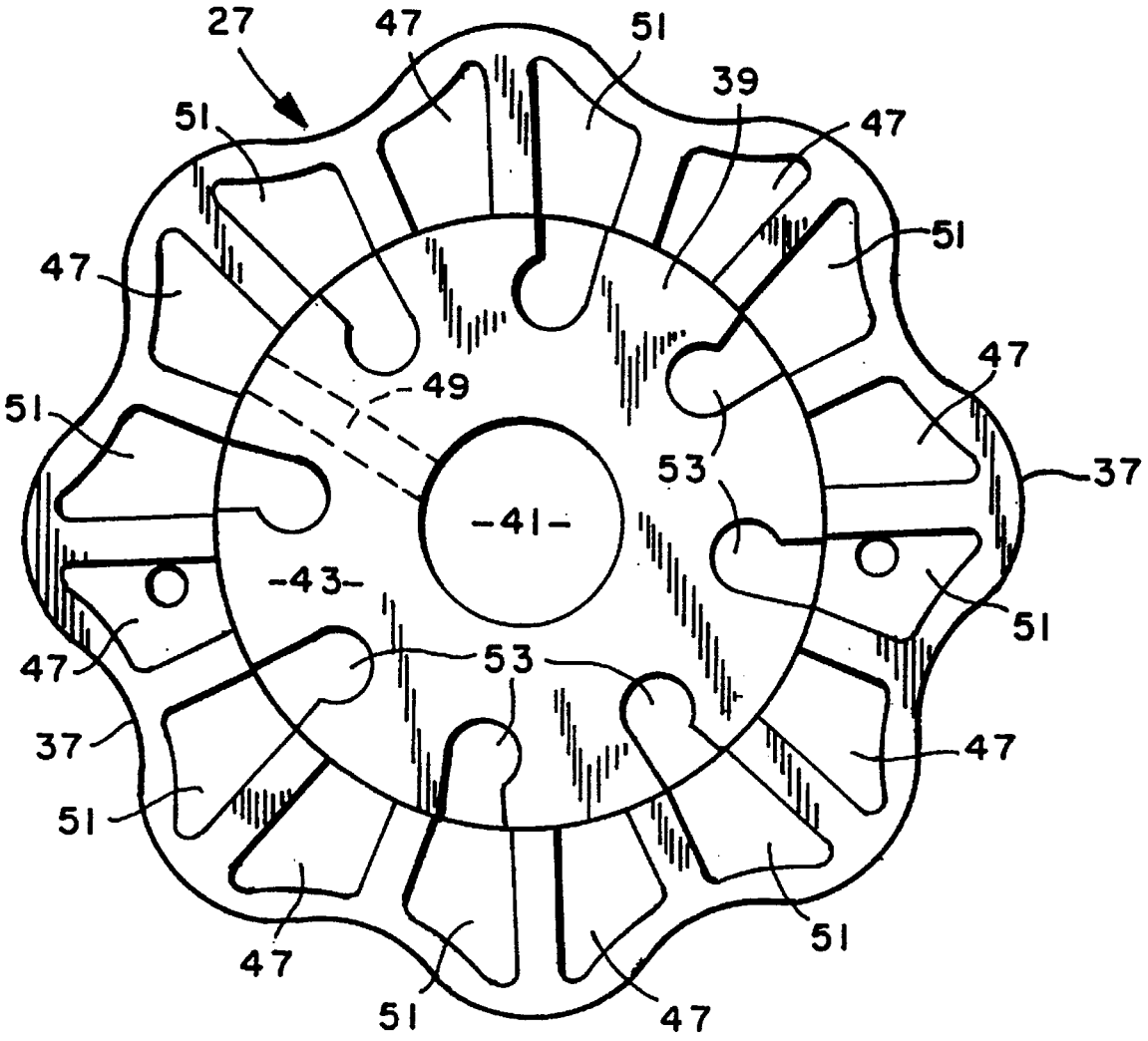
FIG. 2 is a transverse cross-section, taken on line 2—2 of FIG. 1, but illustrating only the gerotor star, and on a scale larger than FIG. 1.

Referring now primarily to FIG. 2, in conjunction with FIG. 1, the star member 27 will be described in greater detail. Although not an essential feature of the present invention, it is preferable that the star 27 comprise an assembly of two separate parts. In the subject embodiment, the star 27 comprises two separate parts including a main star portion 37, which includes the external teeth, and an insert or plug 39. The main portion 37 and the insert 39 cooperate to define the various fluid zones, passages, and ports which will be described subsequently.

The star member 27 defines a central manifold zone 41, formed in an end surface 43 of the star 27, the end surface 43 being disposed in sliding, sealing engagement with an adjacent surface 45 (see FIG. 3) of the stationary valve plate 15. For simplicity, both the end surface of the main star portion 37 and the end surface of the insert 39 are referred to by the numeral "43".

The end surface 43 of the star 27 defines a set of fluid ports 47, each of which is in continuous fluid communication with the manifold zone 41 by means of a fluid passage 49, defined by the insert 39 (only one of the fluid passages 49 being shown in FIG. 2) and being formed internally of the insert 39. The end surface 43 further defines a set of fluid ports 51, which are arranged alternately with the fluid ports 47, each of the fluid ports 51 including a portion 53 which is defined by the insert 39 and extends radially inward, about halfway, radially, to the manifold zone 41. The portions 53 together define an "outer" manifold zone, surrounding the central manifold zone 41. It is preferable, although not essential to the present invention, that the portions 53 of the fluid ports 51 are configured in accordance with the teachings of application U.S. Ser. No. 506,505, U.S. Pat. No. 5,516,268, filed in the names of Gary R. Kassen and Marvin L. Bernstrom for "IMPROVED VALVE-IN-STAR MOTOR BALANCING", assigned to the assignee of the present invention.

Figure 4:
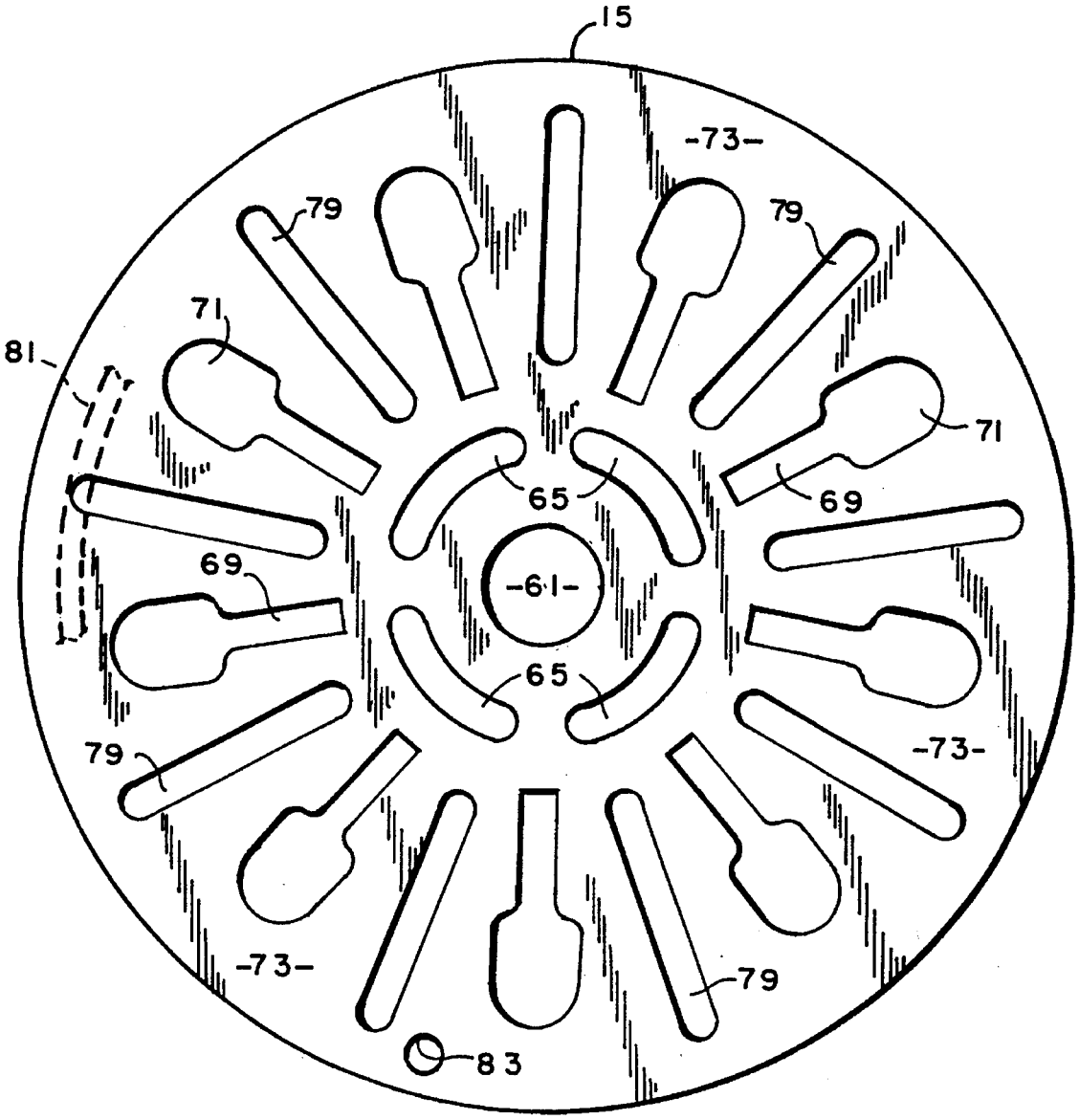
FIG. 4 is a view similar to FIG. 3, but of the opposite side of the stationary valve member, and on a slightly larger scale than FIG. 3.

Referring now primarily to FIGS. 3 and 4, in conjunction with FIG. 1, the endcap member 14 and stationary valve plate 15 will be described in further detail. As may be seen from a review of the above-incorporated patents, it is known in the art to have the endcap and stationary valve plate formed as separate members, as in the subject embodiment, which then may also be referred to as the endcap assembly 13.

The endcap member 14 includes a fluid inlet port 55 and a fluid outlet port 57, although those skilled in the art recognize that most motors are meant to be "bi-directional" in operation, in which case the port 57 would be the inlet and the port 55 would be the outlet. The endcap member 14 defines an annular chamber 59 which is in open, continuous fluid communication with the inlet port 55. The endcap member 14 and the stationary valve plate 15 cooperate to define a cylindrical chamber 61 which is in continuous, open fluid communication with the outlet port 57, and with the manifold zone 41, as the star 27 orbits and rotates. There is an annular pressure chamber, generally designated 63, which includes a plurality of individual stationary pressure ports 65, each of which is in continuous fluid communication with the annular chamber 59 by means of a passage 67 (see FIG. 1).

The stationary valve plate 15 further defines a plurality of stationary valve passages 69, also referred to in the art as "timing slots". In the subject embodiment, each of the valve passages 69 would typically comprise a radially-oriented slot, each of which would be disposed in continuous, open fluid communication with an adjacent one of the volume chambers 29. Preferably, the valve passages 69 are disposed in a generally annular pattern which is concentric relative to the fluid pressure region 63, as is illustrated in FIG. 3. In the subject embodiment, and by way of example only, the valve passages 69 each open into an enlarged portion 71. Each of the bolts 11 passes through one of the enlarged portions 71, but as may be seen in FIG. 3, even with the bolt 11 present, fluid can still be communicated to and from the volume chambers 29 through the radially inner part of each enlarged portion 71.

Referring again primarily to FIG. 1, the plate 19 functions as a "balancing plate", in accordance with the teachings of U.S. Pat. No. 4,976,594, assigned to the assignee of the present invention and incorporated herein by reference. System pressure (high pressure) is communicated to the backside (side adjacent the flange member 21) of the plate 19. For either direction of operation, the radially inward portion of the plate 19 is biased toward the star member 27. In other words, throughout one entire orbit of the star member 27, there is a net force biasing the plate 19 toward the star.

During operation, high pressure fluid is communicated to the inlet port 55, and from there flows to the annular chamber 59, then through the individual passages 67 and into the pressure ports 65. As the star 27 orbits and rotates, the pressure ports 65 engage in fluid communication with the eight radially inward portions 53 of the fluid ports 51 defined by the star 27. Thus, high pressure fluid is being communicated only to those fluid ports 51 which are in fluid communication with one of the valve passages 69, or are about to have such communication or have just completed such communication, as is described in the above-referenced U.S. Ser. No. 506,505.

High pressure fluid is communicated only to those fluid ports 51 which are on the same side of the line of eccentricity as the expanding volume chambers, so that high pressure fluid then flows from those particular fluid ports 51 through the respective stationary valve passages 69, and enlarged portions 71, into the expanding volume chambers 29.

Low pressure exhaust fluid flowing out of the contracting volume chambers 29 is communicated through the respective enlarged portions 71 and valve passages 69 into the fluid ports 47 defined by the star member 27. This low pressure fluid is then communicated through the radial fluid passages 49 into the manifold zone 41, and from there, the low pressure fluid flows through the cylindrical chamber 61, and then to the outlet port 57. It will be understood by those skilled in the art that the overall, "main" flow path through the motor as just described is now generally well known in the art.

Referring now primarily to FIG. 4, one important aspect of the present invention will be described. The stationary valve plate 15 includes an end surface 73 which is disposed adjacent a surface 75 of the endcap member 14. As will be understood by those skilled in the art, it is important for the end surface 73 to remain in tight, sealing engagement with the surface 75. This is especially a concern in view of the fact that the stationary valve passages 69 extend axially through the entire axial extent of the stationary valve member 15. This is done partially to increase the flow area between the ports 47 and 51 and the volume chambers 29, thus decreasing the pressure drop across the motor. Therefore, high pressure fluid in the valve passages 69 is present at the interface of the valve plate 15 and endcap member 14, i.e., at the interface of the surfaces 73 and 75. Although not an essential feature of the present invention, each of the timing slots 69 is typically oriented radially, especially in a VIS motor, to provide the most direct communication between the fluid ports (47 or 51) and the volume chambers 29.

Disposed circumferentially between each adjacent pair of valve passages 69 is a pressure relieving recess 79. By comparing FIG. 4 and FIG. 3 again, it may be seen that the pressure relieving recesses 79 are present only on the backside of the valve plate 15, i.e., unlike the valve passages 69, the pressure relieving recesses 79 do not extend all the way through the valve plate 15, and obviously, must not be in direct fluid communication with any part of the main flow path through the motor, as described previously. In the subject embodiment, and by way of example only, the recesses 79 are elongated and, because of the radial orientation of the timing slots 69, the recesses 79 are also oriented radially.

The primary function of the pressure relieving recesses 79 is to receive or collect any leakage fluid which would otherwise flow along the interface between the surfaces 73 and 75, from a timing slot 69 containing high pressure, toward an adjacent timing slot 69 containing low pressure. As is well known to those skilled in the art, in an 8-9 gerotor, at any given instant in time, four adjacent timing slots will contain high pressure, then one timing slot will be a "changeover" slot, and the remaining four timing slots will contain low pressure. Therefore, at any given instant of time, there is only one location on a valve plate at which a high pressure timing slot is disposed immediately adjacent a low pressure timing slot, and that location "progresses" or travels around the valve plate at the rotational speed of the star member 27. In other words, each adjacent pair of timing slots 69 at some point defines the interface between high pressure and low pressure. Accordingly, it is one important aspect of the present invention that there be one of the pressure relieving recesses 79 between almost every adjacent pair of timing slots 69, and in the subject embodiment, there is one recess 79 for each and every adjacent pair of timing slots 69.

As may best be seen in FIG. 4, the radially inward extent of each of the recesses 79 is approximately the same as the radially inward extent of each of the timing slots 69. However, in accordance with another important aspect of the present invention, the radially outward extent of each of the recesses 79 is substantially beyond that of each of the enlarged portions 71. Each recess 79 extends radially outward far enough to be in fluid communication with an O-ring groove 81 (part of which is shown in dashed lines in FIG. 4), which can be defined by either the endcap member 14 (see FIG. 1 ), or the valve plate 15, and is inherently a "source" or "region" of low pressure. More specifically, the O-ring groove 81 is in communication with, by way of example only, the "case drain" region of the motor, i.e., the area disposed radially between the shaft 33 and the flange member 21. As may best be seen in FIG. 1, and by way of example only, the pressure is drained from the O-ring groove 81 by means of an axial passage 83 which extends through the valve plate 15, through the gerotor ring 23, then through the balance plate 19 and into the flange member 21. From there, communication of leakage fluid is through an angled passage 85 to the case drain region.

During the development of the present invention, a motor was tested with and without the pressure relieving recesses 79. As was mentioned in the BACKGROUND OF THE DISCLOSURE, with increasing pressure differential across the motor, the volumetric efficiency decreases, but an important aspect of the invention is to greatly reduce the amount by which the volumetric efficiency decreases. In conducting the testing, a single motor was operated, first without the recesses 79 ("PRIOR ART"), then again after the recesses 79 had been added ("INVENTION"). The presence or absence of the recesses 79 had very little effect on the performance of the motor in the counterclockwise direction. Therefore, the test data shown below is for the clockwise direction of operation only. "PRESSURE DIFFERENTIAL" is in PSI, "RPM" refers to the measured output speed of the motor, and "EFF" refers to volumetric efficiency, as a percentage.

| PRESSURE | PRIOR ART | | INVENTION | |
|---|---|---|---|---|
| DIFFERENTIAL | RPM | EFF | RPM | EFF |
| 1000 | 92 | 95.9 | 92 | 96.0 |
| 2000 | 88 | 91.8 | 87 | 90.8 |
| 3000 | 83 | 86.6 | 85 | 88.7 |
| 4000 | 80 | 83.5 | 82 | 85.5 |
| 5000 | 69 | 72.0 | 76 | 79.3 |

The motor of the present invention is intended as a "high pressure" motor, and therefore, what is most important in the above test data is the performance at 5000 PSI, at which the motor of the INVENTION results in an output speed 7 RPM higher, for the same input flow, and an increase in volumetric efficiency of 7.3%. Both of these increases would be considered significant to those skilled in the art.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

We claim:

1. A rotary fluid pressure device of the type comprising housing means including an endcap assembly defining a fluid inlet port and a fluid outlet port; a gerotor gear set associated with said housing means and including an internally-toothed ring member, defining a plurality N+1 of internal teeth, and an externally-toothed star member defining a plurality N of external teeth, said star member being eccentrically disposed within said ring member for relative orbital and rotational movement therebetween, the teeth of said ring member and said star member interengaging to define a plurality N+1 of expanding and contracting fluid volume chambers during said relative orbital and rotational movements; said endcap assembly including an endcap member, and a stationary valve member, and defining a first fluid pressure region in continuous fluid communication with said inlet port and a second fluid pressure region in continuous fluid communication with said outlet port, said first fluid pressure region surrounding said second fluid pressure region; said stationary valve member further defining a plurality N+1 of valve passages, each being oriented generally radially and being in continuous fluid communication with one of said fluid volume chambers; said star member defining first and second manifold zones in continuous fluid communication with said first and second fluid pressure regions, respectively, said star member including an end surface disposed in sliding, sealing engagement with an adjacent surface of said stationary valve member, said end surface defining a first plurality N of fluid ports and a second plurality N of fluid ports, said first and second pluralities of fluid ports being in continuous fluid communication with said first and second manifold zones, respectively; characterized by:

(a) each of said valve passages extending axially through the entire axial extent of said stationary valve member over at least a portion of the area thereof;

(b) one of said endcap member and said stationary valve member defining a plurality of pressure relieving recesses, each of said pressure relieving recesses being elongated and oriented generally radially, and each of said recesses being disposed circumferentially between an adjacent pair of said valve passages;

(c) one of said endcap member and said stationary valve member defining a region of relatively low fluid pressure disposed radially outward from said valve passages; and (d) each of said pressure relieving recesses being in fluid communication with said region of relatively low fluid pressure, thereby relieving any fluid pressure buildup between said endcap member and said stationary valve member tending to exert a separating force therebetween.

2. A rotary fluid pressure device as claimed in claim 1, characterized by said plurality of pressure relieving recesses being defined by said stationary valve member, on a surface thereof disposed in tight sealing engagement with an adjacent surface of said endcap member.

3. A rotary fluid pressure device as claimed in claim 1, characterized by said region of relatively low fluid pressure comprises an annular groove defined by said endcap member, each of said pressure relieving recesses extending radially a sufficient distance to communicate with said annular groove.

4. A rotary fluid pressure device as claimed in claim 1, characterized by said plurality of pressure relieving recesses comprises a plurality N+1 of said recesses, said recesses and said valve passages being arranged in a circumferentially alternating pattern.

5. A rotary fluid pressure device of the type comprising housing means including an endcap assembly defining a fluid inlet port and a fluid outlet port; a gerotor gear set associated with said housing means and including an internally-toothed ring member, defining a plurality N+1 of internal teeth, and an externally-toothed star member defining a plurality N of external teeth, said star member being eccentrically disposed within said ring member for relative orbital and rotational movement therebetween, the teeth of said ring member and said star member interengaging to define a plurality N+1 of expanding and contracting fluid volume chambers during said relative orbital and rotational movements; said endcap assembly including an endcap member, and a stationary valve member; said stationary valve member further defining a plurality N+1 of valve passages, each being oriented generally radially and being in continuous fluid communication with one of said fluid volume chambers; said star member (27) defining first and second manifold zones in continuous fluid communication with said fluid inlet port and said fluid outlet port, respectively, said star member including an end surface disposed in sliding, sealing engagement with an adjacent surface of said stationary valve member, said end surface defining a first plurality N of fluid ports and a second plurality N of fluid ports, said first and second pluralities of fluid ports being in continuous fluid communication with said first and second manifold zones, respectively; characterized by:

(a) each of said valve passages being in fluid communication with an interface of the endcap member and the stationary valve member;

(b) one of said endcap member and said stationary valve member defining a plurality of pressure relieving recesses, each of said pressure relieving recesses being elongated and oriented generally radially, and each of said recesses being disposed circumferentially between an adjacent pair of said valve passages;

(c) one of said endcap member and said stationary valve member defining a region of relatively low fluid pressure disposed radially outward from said valve passages; and (d) each of said pressure relieving recesses being in fluid communication with said region of relatively low fluid pressure, thereby relieving any fluid pressure buildup between said endcap member and said stationary valve member tending to exert a separating force therebetween.

6. A rotary fluid pressure device as claimed in claim 5, characterized by said plurality of pressure relieving recesses being defined by said stationary valve member, on a surface thereof disposed in tight sealing engagement with an adjacent surface of said endcap member.

7. A rotary fluid pressure device as claimed in claim 5, characterized by said region of relatively low fluid pressure comprises an annular groove defined by said endcap member, each of said pressure relieving recesses extending radially a sufficient distance to communicate with said annular groove.

8. A rotary fluid pressure device as claimed in claim 5, characterized by said plurality of pressure relieving recesses comprises a plurality N+1 of said recesses, said recesses and said valve passages being arranged in a circumferentially alternating pattern.

* * * * *